United States Patent [19]

Abler

[11] 4,102,023

[45] Jul. 25, 1978

[54] CONTOUR SHEAR DEVICE FOR PILE FABRICS

[75] Inventor: Norman Christian Abler, Menomonee Falls, Wis.

[73] Assignee: Bunker Ramo Corporation, Oak Brook, Ill.

[21] Appl. No.: 719,017

[22] Filed: Aug. 30, 1976

[51] Int. Cl.[2] ..... D06C 23/02

[52] U.S. Cl. ..... 26/16

[58] Field of Search ..... 26/15 R, 16, 51.3, 87, 26/30; 226/197

[56] References Cited

U.S. PATENT DOCUMENTS

| | | | |
|---|---|---|---|
| 1,553,830 | 9/1925 | Marble | 26/16 |
| 1,587,528 | 6/1926 | Horstmann | 26/15 R |
| 2,206,243 | 7/1940 | Turano | 26/15 R |

*Primary Examiner*—Robert R. Mackey

*Attorney, Agent, or Firm*—F. M. Arbuckle; L. Steadman

[57] ABSTRACT

A contour shear rest is disclosed for use in a plane shearing machine to simulate, in a three dimensional deep-pile fabric, the effect obtained by sewing together small animal pelts such as mink. The shear rest has a contour surface made up of elements forming a mirror image of a desired contour. The contour surface is formed so that the length of the travel path of fabric drawn across its face is uniform. Tension applied to fabric drawn across the various surfaces is therefore uniform and fabric distortion is substantially eliminated. Subsequently, as the fabric is sheared, it is provided with desired natural-looking contours.

11 Claims, 17 Drawing Figures

Fig. 1
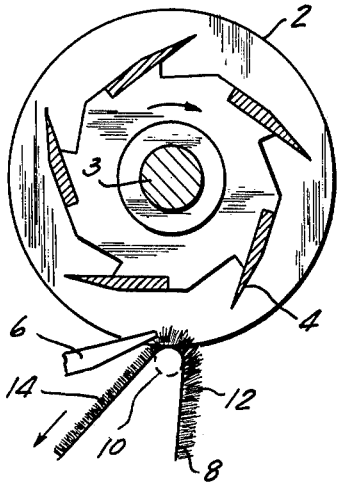
Fig. 2
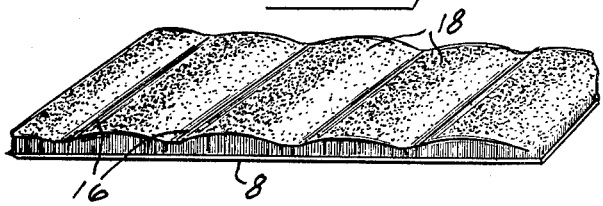
Fig. 3
(PRIOR ART)
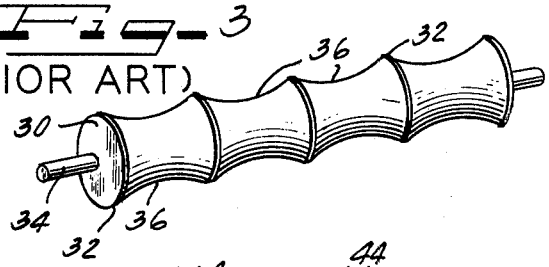
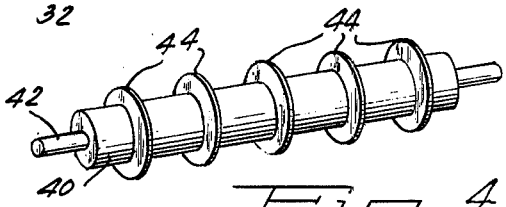
Fig. 4
(PRIOR ART)
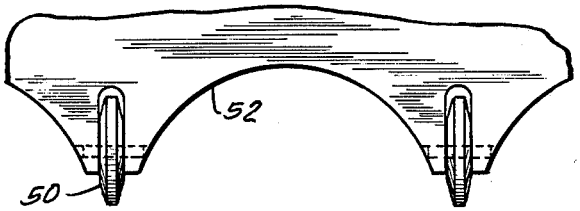
Fig. 5
(PRIOR ART)
Fig. 6
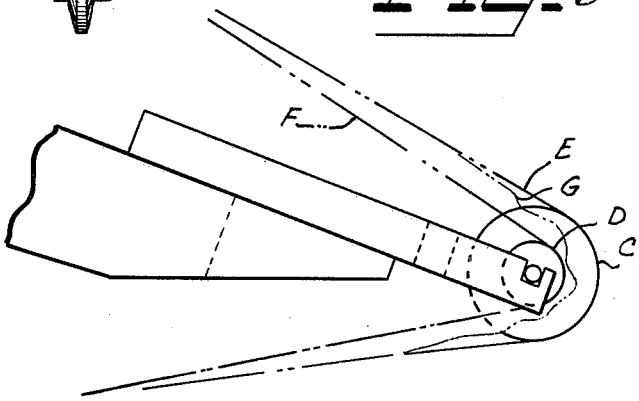
Fig. 7
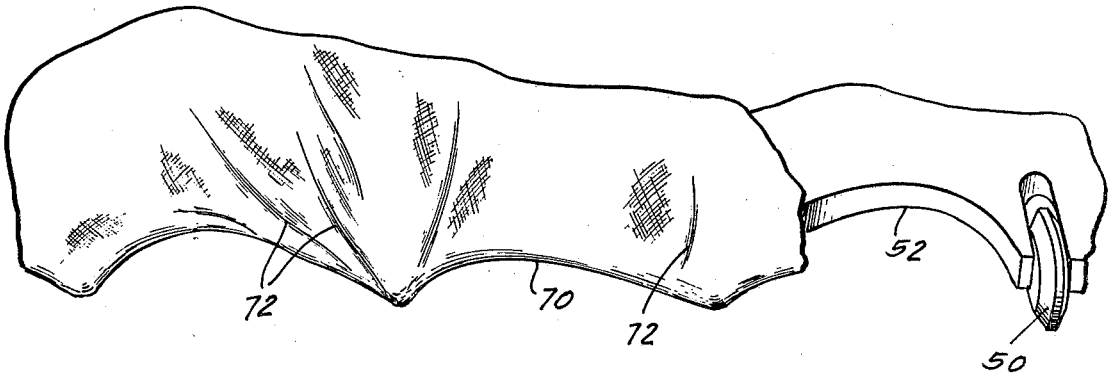

CONTOUR SHEAR DEVICE FOR PILE FABRICS

BACKGROUND OF THE INVENTION

1. Field of the Invention

The present invention relates to the provision of contours in deep-pile fabrics and especially to simulating contours found in natural furs and the like. In particular, it relates to provisions for distorting a fabric base in such a way that natural-looking contours can be imparted to deep-pile fabrics by plane shearing the fabrics.

2. Description of the Prior Art

Efforts have been made in the past to provide threedimensional deep-pile fabrics which simulate the effect obtained by sewing together small animal pelts, such as mink, to form natural-fur garments. These past efforts generally have involved distorting the fabric base at the shear rest as the fabric is passed through the shear. This has required that the base or back of the fabric be distorted into a shape which is a mirror image of the contour desired on the finished pile surface.

The various means proposed in the prior art for controlling the shape of the fabric back have proven to be unsatisfactory. They have all caused some portions of the fabric to be stressed and strained excessively while other portions have been left uncontrollably loose. These conditions have caused contour shapes to be very irregular in the finished pile.

Attempts have been made to eliminate irregularities in the contours of the finished pile by controlling the loose portions of the pile by means which engage the pile side of the fabric. These prior art attempts have caused other surface discontinuities and have resulted in serious operating problems, such as causing erratic tracking of the web, edge flutter, chopping at the fabric edge, and tearing of seams which join pieces of the fabric into one continuous web.

SUMMARY OF THE INVENTION

In view of the foregoing, it is an object of the present invention to provide an improved contour rest which will enable fabrics to be contour sheared as readily as they may be plane sheared. It is a further object to provide means enabling deep-pile fabrics to be sheared to contours simultating the appearance of natural-furs and the like. It is yet another object to avoid distortions of the pile fabric which have caused irregularity in the contours.

In order to attain the foregoing objects and others ancillary thereto, an improved shear rest is provided for use with a plane shearing machine to enable the production of pile fabrics simulating a plurality of rows of attached pelts, or the like. The shear rest includes contour surfaces which are mirror images of contours to be formed in a fabric. The contour surfaces are designed such that the fabric when passing over them traverses the same distance over all surfaces and is subjected to substantially the same amount of tension throughout to eliminate fabric distortion. More specifically, the shear rest is formed from a metal blank which is bent into a U-shape. In a particular embodiment, the apex of the bent blank is deformed to provide a first contour representing high points of the shear rest and the sides of the bent blank are deformed to protrude laterally in areas adjacent the low points of the apex contour. The deformation of the bent blank has the effect of providing fabric paths on the shear rest which are substantially of the same length over all regions thereof and which eliminate the prior art problem of fabric sag over the low portion of the shear rest and thus eliminate fabric distortion.

BRIEF DESCRIPTION OF THE DRAWINGS

The above mentioned and other features and objects of this invention and the manner of obtaining them will become apparent, and the invention itself will be best understood by reference to the following description of embodiments of the invention taken in conjunction with the accompanying drawings, in which, FIG. 1 is a crossectional view showing a shear in use to cut a pile fabric supported by a fabric rest, FIG. 2 is a perspective view of a portion of pile fabric as it would appear after being sheared to a desired contour, FIGS. 3, 4 and 5 are views of a variety of shear rests according to the prior art, FIG. 6 is a diagram disclosing the differences in path lengths of web paths over different portions of a contour rest designed according to FIGS. 3, 4 and 5, FIG. 7 shows an example of web distortion typical when an attempt is made to shear a nonstretchable web using a prior art contour rest.

DESCRIPTION OF A PREFERRED EMBODIMENT

Figure 8:
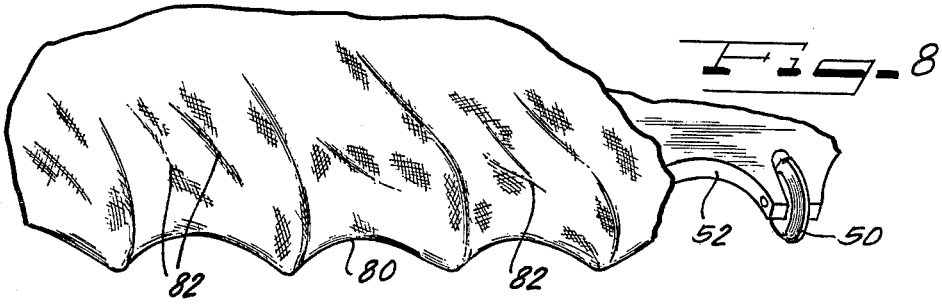
FIG. 8 is an example of web distortion typical when an attempt is made to shear a two-way stretch web with a prior art contour rest.

FIG. 1 is a view in partial section of a shear mechanism showing a conventional way in which a deep-pile fabric may be plane sheared to shorten fibers to a single length. In this view, a shear arbor 2 is rotated in the direction of the arrow about its central axis 3 to bring arbor blades, or shear blades, 4 successively into shearing relationship with ledger blade 6. Concurrently, a pile fabric 8 is moved over the face of a fabric rest 10 so that the long fibers 12, which are shown in this example to be of uneven length, may be sheared, leaving short fibers of uniform length, as indicated at 14.

FIG. 2 is a perspective view of a pile fabric 8 which has been sheared in a selective way to have contours represented by shorter fibers in the low areas 16 and longer fibers in the high areas 18. These contours may be selected to provide a number of desirable effects, including the simulation of natural fur, such as mink, which has been sewn together from pelts.

Examples of prior art fabric rests which have been used to contour fabrics are shown in FIGS. 3, 4 and 5. Each of these fabric rests represents the mirror image of a desired contour. The large diameters 32 of the convolutions on the spool 30 on the shaft 34 shown in FIG. 3 hold the fabric close to the shears, causing the corresponding region of pile to be sheared close as at 16 in FIG. 2. The small diameters 36 of the spool permit the fabric to be pulled back somewhat from the shears, resulting in longer pile, such as 18 in FIG. 2. However, the results have not been consistent when procedures employing this apparatus have been used, because the fabric has not been completely controlled in the region of the small diameters.

FIG. 4 shows a spool 40, on a shaft 42, which supports a number of wheels or discs 44. These wheels or discs have cylindrical faces, or have been chamfered to present circular edges. The problems and considerations associated with a system employing the apparatus of FIG. 4 are much the same as those discussed with respect to FIG. 3, but in practice have been even more severe.

FIG. 5 shows a variation of the apparatus and method of FIG. 4, wherein wheels 50 are mounted independently on a base 52 to permit more slack between wheels and freer flow of fabric over the shear rest. This method presents even more operating problems than the other two. However, this apparatus has been of interest, since it provides a different means to take up looseness without blocking access of the fiber to the shear.

Reasons for the failure of these prior art fabric shear rests to function as desired can be seen from the diagram of FIG. 6 in which C designates the largest diameter of the contoured spool or wheel, D is the corresponding smallest diameter, E is the shape of the web portion which passes over the largest diameter, F is the theoretical shape of the web portion which passes over the smallest diameter, and G represents the actual typical random shape of the web portion in the region of the smallest diameter.

FIG. 6 clearly shows that web path "E" is considerably longer than web path "F". Thus, for the web to be under control in both regions, the web would have to be stretched in region "E" by an amount equal to the path differential between regions without causing any stretch in region "F". This is impossible to accomplish with a stable fabric such as woven material or backcoated (stabilized) sliver knit. Even with a "two-way stretch" material such as unstabilized sliver knit, it is difficult to provide such stretch because stresses between the two neighboring extremes will cause diagonal wrinkles between alternate extreme regions. Also, contours which are sheared before stabilization usually become distorted during stabilization, making it even more impractical to shear unstabilized fabric. To minimize the problems associated with the loss random path "G", narrow tapes or belts have been employed which engage the fabric in the associated region. Although such methods improve the consistency of the contour shape, they produce narrow bands in which no pile can be sheared and cause the operating problems described earlier.

FIGS. 7 and 8 show web distortions which are typical of those encountered with the apparatus of the prior art. FIG. 7 shows a nonstretchable web 70 and FIG. 8 shows a web 80 which two-way stretch. The web distortions which can be seen in these fabrics, as represented by lines at 72 and 82, respectively, also occur in the back of a sliver-knit fabric and result in undesirable surface irregularities in the finished pile surface.

Figure 9:
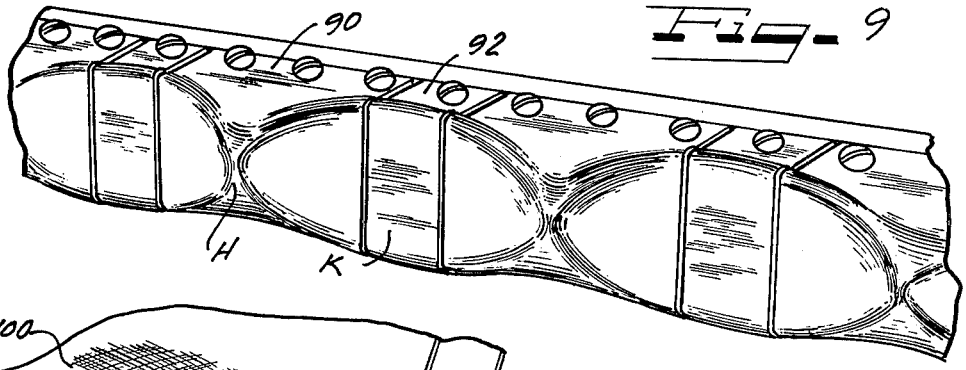
FIG. 9 is a perspective view of a shear rest in accordance with the present invention.
Figure 13:
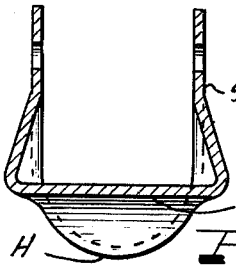
FIGS. 13 and 14 show respective end and side views of a formed element for use in the practice of the invention.
Figure 14:
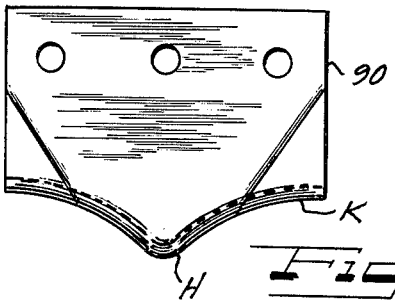
Figure 15:
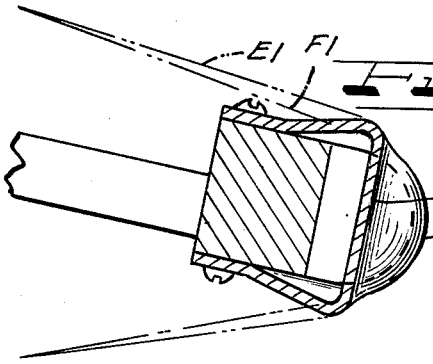
FIG. 15 is a diagram disclosing that with the present invention the path lengths over different web paths are identical.
Figure 16:
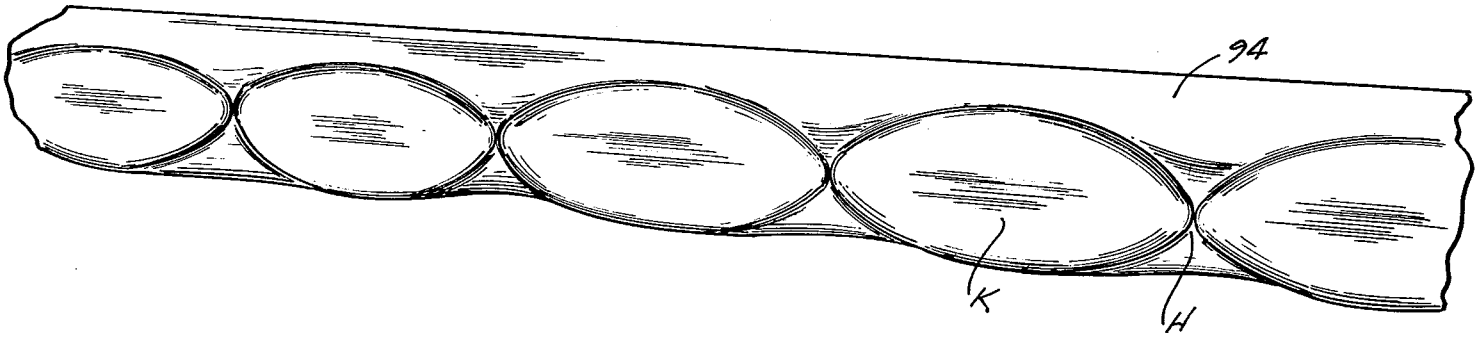
FIG. 16 is a perspective view of an embodiment of a shear rest formed from a single piece of material.

FIG. 9 shows an embodiment of a contour shear rest according to the present invention which is made up of alternating elements 90 and contour spacers 92, each of which is formed from a sheet of steel. As indicated in FIG. 16, the entire shear rest can be fabricated from a single sheet; however, if in a preferred embodiment it is made up of individual elements 90, the spacing between elements can be varied by varying the length of spacers 92 inserted between them. The elements 90 are shown to have contour faces H the surfaces of which are selected to bring pile fabrics into close proximity to shearing means; and the spacers 92 have contour faces K the surfaces of which are selected to bring pile fabrics into less close proximity to shearing means. The faces H and K constitute a contoured section of the shear rest and provide web paths over the shear rest of substantially the same length. To this end, as seen in FIGS. 13, 14 and 15, the contours K extend transversely relative to the shear rest, i.e., axially with respect to the direction of travel of the pile fabrics, to compensate for the less close proximity to the shearing means.

Figure 10:
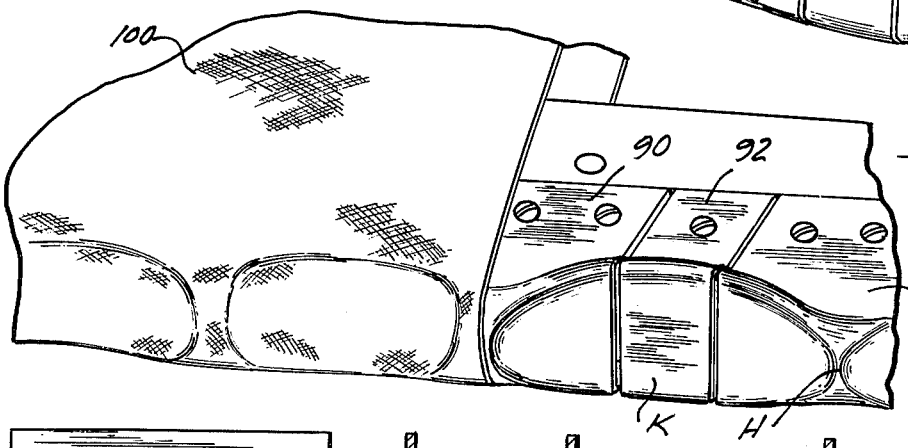
FIG. 10 is a perspective view of a shear rest similar to that in FIG. 9 in which a portion of pile fabric is shown evenly stretched over the shear rest.

As indicated in FIG. 10, a pile fabric 100 may be drawn across the contour faces H and K of the fabric rest 90, 92 to provide a fabric surface which is completely under control and free of distortion across its entire expanse. It will be recognized of course that the fabric rest may be made up of twopart elements such as 90, 92 of FIG. 10, or alternately of close spaced single part elements 90 by omitting spacers 92.

Figure 17:
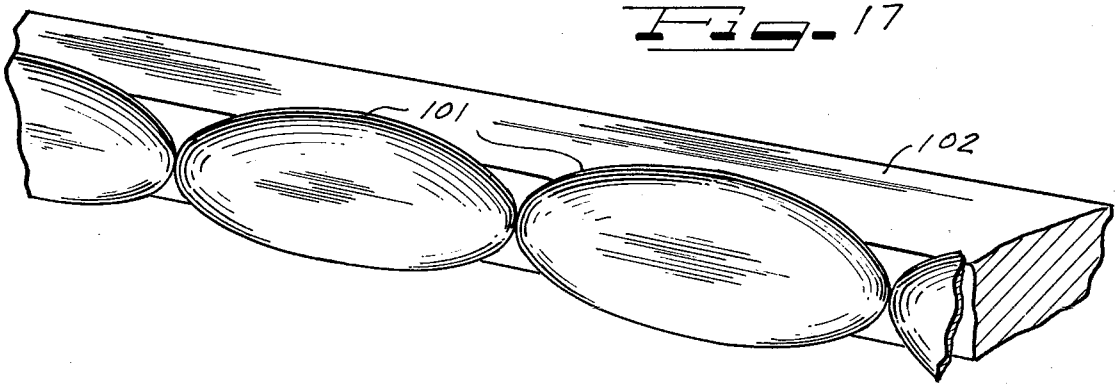
FIG. 17 is a perspective view of a shear rest in accordance with the invention in which a plurality of elements are combined to determine the length of the web path.

It will also be recognized that all the repetitive contours could be formed on a single continuous sheet, as shown in FIG. 17, although we have found it to be easier and more economical to make individual elements. As the fabric is drawn across the rest it may be sheared precisely by shear blades such as those disclosed in FIG. 1 to form a surface which is a mirror image of the contour of the shear rest.

The spacers 92 shown in FIG. 9 may be made in various lengths to provide desired spacing between contour features on alternate elements 90. These spacers, as shown at K in FIG. 13, are formed to provide the same travel distance across their faces for pile fabrics as are provided by faces of the elements 90, as indicated at H in FIG. 13. Consequently, the forces applied across a fabric as it is pulled over the contour faces is substantially the same across K as it is across H.

Figure 11:
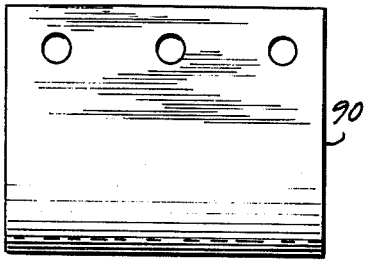
FIGS. 11 and 12 show respective side and end views of unformed blanks for use in the production of embodiments of the invention.
Figure 12:
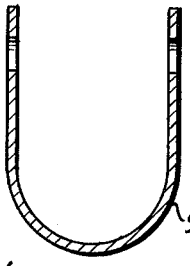

By looking at how the elements are fabricated in FIGS. 11, 12, 13 and 14, it can be seen that it is possible to insure that the length of web path is the same in all regions of an element. First a blank is bent, as indicated in FIGS. 11 and 12, in a simple 180 degree bend which results in a shear rest shape suitable to shear plain surfaces as is done with the apparatus of FIG. 1. It is obvious at this point that the web path in all regions is of equal length. Next the contoured portion of the blank is formed (by hammering or pressing) to any desired shape, as shown for example at H and K in FIGS. 13 and 14. Forming is done in a manner that does not significantly stretch nor compress the metal in the blank. Deformation manifests itself primarily in bending. Thus, the web-path length in all regions of the formed element 90 is substantially unchanged from that of its original blank. Therefore, it will be seen that the web-path length is substantially equal in all regions of the shear rest regardless of the contour shape.

FIG. 15 shows a profile view of the new rest and illustrates web paths across the new rest. From FIG. 15 it can be seen that the length of the web path in region F1 across the top of contour H, where the pile is cut short, is equal to the length of the web path in region E1 across the contour K, where the pile is cut longest. Surface "H" is a contoured surface which makes a gradual transition between the cross-sectional shapes of regions "E1" and "F1". The result is that any web of fabric which is pulled over the shear rest will conform accurately and consistently to the shape of the shear rest with a minimum amount of tension, and the tension will remain uniform across the web. This can readily be seen from FIG. 10, which shows a stabilized fabric 100 on the rest. A similar result may be obtained with an unstabilized piece of jersey, or the like.

FIG. 16 shows an embodiment of a shear rest at 94 which is formed from a single piece of material. If desired, the contour faces at H and K may be shaped to correspond to faces which are labeled the same in the other figures.

From the resultant shape of the contoured surfaces H and K shown in FIGS. 9 and 16, it can be seen that a contour shear rest could be made as shown in FIG. 17 in which the web path over the shear rest is substantially the same length at any position across the width of the fabric. This rest is made by cutting a proper oval shape 101 from a sheet of material, forming it and fastening it to the support bar 102 by welding or other suitable means. Such a shear rest is in the spirit of this invention, that is it's principle attribute is that the web path length is substantially constant across the width of the web.

While the principles of the invention have been described above in connection with specific apparatus and applications, it is to be understood that this description is made only by way of example and not as a limitation on the scope of the invention.

I claim:

1. Apparatus for use in shearing pile fabrics to a particular contour comprising:

a shear rest, a contour surface forming a part of said shear rest and providing a web path over said part of said shear rest, a portion of said contour surface forming a mirror image of a contour to be provided on finished pile fabric surfaces, said contour surface including a plurality of distinguishable contours arranged in cooperative association with each other, the contours being selected such that the length of the web path over the contour surface in the direction of travel of a pile fabric is the same across each distinguishable contour of the contour surface.

2. The invention as claimed in claim 1, in which the contour surface is formed from a plurality of individual elements, said individual elements include contoured elements and contoured spacers, said spacers are used to separate the contoured elements, and spacing between the contoured elements can be varied to change the contour spacing by changing the spacers between them.

3. The invention as claimed in claim 1, in which the contour surface is fabricated from a single element.

4. The invention as claimed in claim 1, in which the contour surface is fabricated from a plurality of contoured elements.

5. Apparatus for shearing continuously travelling lengths of pile fabrics to a desired contour, comprising:

shearing means;

a shear rest over which a pile fabric may travel, said shear rest incorporating contour means, said contour means including first contour elements having surfaces to bring pile fabrics into close proximity to said shearing means, and said contour means having second contour elements having surfaces to bring pile fabrics into less close proximity to said shearing means, the contour surfaces of said second contour elements being extended in the direction of the axis of travel of the pile fabric over the shear rest sufficiently to compensate for said less close proximity so that web paths formed thereby in the direction of the axis of travel of the pile fabric are of substantially equal length across each distinguishable contour of the contour elements to promote even contouring of a pile fabric sheared on the shear rest.

6. The invention as claimed in claim 5, in which the contour means is formed from a plurality of individual elements, said individual elements include contoured elements and contoured spacers, said spacers are used to separate the contoured elements, and spacing between the contoured elements can be varied to change the contour spacing by changing the spacers between them.

7. The invention as claimed in claim 5, in which the contour means is formed from a single element to include said first and second contour elements.

8. The invention as claimed in claim 5, in which the contour means is formed from a plurality of individual contoured elements, and the contoured elements are fitted together.

9. Apparatus for use in pile fabrics to a particular contour comprising, support means over which a pile fabric may be drawn for shearing, said support means including a contoured surface, the contoured surface including a first region in which a pile fabric may be presented for shearing, the first region presenting a mirror image of a contour desired for the surface of a pile fabric, and the contoured surface including other regions adjoining the first region in depressed relation, the contours of said other regions being extended relative to said first region to support the pile fabric in a manner to form together with the first region a travel path of uniform length for pile across the contoured surface to assure that forces of equal magnitude are presented across all parts of the pile fabric.

10. Apparatus for use in shearing pile fabrics to a particular contour in a plane shearing machine comprising, a ledger blade, a shear blade, the ledger blade and shear blade defining a shear line where they meet to shear a pile fabric, a shear rest, the shear rest providing support for a pile fabric to be sheared, a contour surface formed as part of said shear rest, the contour surface establishing a contour to which a pile fabric is to be sheared in a region adjacent and parallel to the shear line, and the contour surface being shaped so that certain area of the contour surface is closer to the shear line than other area of the contour surface and said other area being extended transversely relative to said shear rest and in the direction of the travel axis of pile fabric travelling over the shear rest and relative to said certain area of the contour surface, thereby providing paths of equal length for pile fabric drawn across the shear rest to assure that forces of equal magnitude are presented across all parts of the fabric.

11. Apparatus for use in shearing pile fabrics to a particular contour comprising:

a shear rest having a contoured section, said contoured section providing a path over which a pile fabric may travel to be sheared, a first portion of said contoured section forming a mirror image of a contour to be provided to the pile fabric, and a second portion of said contoured section being depressed relative to said first portion and extended in the direction of said path to compensate for the contour of said first portion in said path and thereby providing substantially uniform contact for a substantial width of pile fabric drawn along said path across all of the portions, whereby the pile fabric is prepared for shearing to conform to said contour substantially without distortion.

* * * * *